US010913007B2

(12) United States Patent
Johansen

(10) Patent No.: US 10,913,007 B2
(45) Date of Patent: Feb. 9, 2021

(54) INVERTIBLE INTERACTIVE TOY HOUSE

(71) Applicant: Yvonne Johansen, Sherman Oaks, CA (US)

(72) Inventor: Yvonne Johansen, Sherman Oaks, CA (US)

( * ) Notice: Subject to any disclaimer, the term of this patent is extended or adjusted under 35 U.S.C. 154(b) by 0 days.

(21) Appl. No.: 15/137,885

(22) Filed: Apr. 25, 2016

(65) Prior Publication Data

US 2017/0304738 A1 Oct. 26, 2017

(51) Int. Cl.
*A63H 3/52* (2006.01)

(52) U.S. Cl.
CPC ..... *A63H 3/52* (2013.01)

(58) Field of Classification Search
CPC ..... A63H 3/52; A63H 33/16; A63H 33/42; A63F 9/008
USPC ..... 446/476, 478, 487, 488
See application file for complete search history.

(56) References Cited

U.S. PATENT DOCUMENTS 536,162 A * 3/1895 Stiefel ..... B65D 81/368 229/116.4
619,757 A * 2/1899 Johnstone et al. ... B65D 81/368 229/116.4
937,173 A * 10/1909 Pfeiffer ..... B65D 5/36 229/102.5
1,237,161 A * 8/1917 Bowen ..... A63J 19/00 40/518
1,756,526 A * 4/1930 Thompson ..... A63H 3/52 446/478
1,881,356 A * 10/1932 Gold ..... A63H 3/52 446/478
2,020,196 A * 11/1935 Mallgraf ..... A63H 3/52 446/478
2,032,531 A * 3/1936 Eaton ..... A63H 3/52 446/80
2,441,076 A * 5/1948 Makrianes ..... A63H 3/52 446/109
2,535,792 A * 12/1950 Goodale ..... A63H 3/52 135/115
2,581,100 A * 1/1952 Hennessy ..... B65D 81/368 206/194
3,016,042 A * 1/1962 Curn, Jr. ..... A01K 1/033 119/499

(Continued)

OTHER PUBLICATIONS

Hide and Seek with Washable Markers Playhouse (Review dated Mar. 30, 2014).*

*Primary Examiner* — Joseph B Baldori
(74) *Attorney, Agent, or Firm* — Brooks Kushman P.C.

(57) ABSTRACT

An invertible interactive toy house comprising a series of adjacent foldable segments that can be assembled by folding in either of two different directions and joined at its outer edges to form a self-standing toy house. When folded in one direction, the assemble house displays its outside features. When folded in the opposite direction, the assembled house displays its inside features. Figures which correspond to the indicia on the walls of the house are provided. The figures are removably affixed to corresponding indicia on the walls of the toy house. Playing with this toy house has been found to teach children with learning difficulties to improve various skills, including non-verbal skills of focus and attention, social skills, visual attention and processing skills, and ability to recognize different sizes and shapes, as well as general language skills.

8 Claims, 6 Drawing Sheets

(56) References Cited

U.S. PATENT DOCUMENTS 3,363,360 A * 1/1968 Ryan ..... A63H 3/52 446/478
3,548,552 A * 12/1970 McBride ..... A63H 33/044 446/110
4,190,978 A * 3/1980 Nelson ..... A63H 33/008 446/478
4,467,572 A * 8/1984 Somers ..... A63H 33/008 16/225
4,778,392 A * 10/1988 Mitchell ..... G09B 1/00 206/509
4,964,249 A * 10/1990 Payne ..... A63H 33/008 446/478
4,992,068 A * 2/1991 Conrad ..... A63H 33/008 229/122
5,046,457 A * 9/1991 Ashcroft ..... A01K 1/033 119/168
5,055,083 A * 10/1991 Walker ..... A63H 33/044 446/476
5,069,623 A * 12/1991 Peat ..... G09B 1/06 434/260
5,096,204 A * 3/1992 Lippman ..... A63H 33/38 273/285
5,265,848 A * 11/1993 Michaud ..... E04H 17/18 256/24
5,269,691 A * 12/1993 Waldman ..... G09B 11/04 40/594
5,301,478 A * 4/1994 Maese, Jr. ..... A63H 33/008 446/478
5,435,769 A * 7/1995 Bertrand ..... A63H 33/044 446/476
5,445,380 A * 8/1995 Polsky ..... A63F 9/088 273/155
5,542,870 A * 8/1996 Westersund ..... A63H 33/062 220/324
D381,705 S * 7/1997 Panthofer ..... D21/506
5,752,470 A * 5/1998 Koneke ..... A01K 1/033 119/499
5,865,140 A * 2/1999 McGivern ..... A01K 1/0125 119/168
D406,234 S * 3/1999 Metter ..... D9/432
5,971,833 A * 10/1999 Rasmussen ..... G09F 5/00 40/539
6,108,982 A * 8/2000 Davison ..... A63H 3/52 446/478
6,146,238 A * 11/2000 Daiber ..... A63H 33/00 446/476
6,250,021 B1 * 6/2001 Ferrara, Jr. ..... E04B 1/344 446/423
7,241,198 B1 * 7/2007 Boone ..... A63H 3/52 446/110
7,258,592 B2 * 8/2007 Colak ..... A63H 3/52 446/476
D554,060 S * 10/2007 Park ..... D21/510
7,552,563 B2 * 6/2009 Becker ..... B42D 15/042 229/108
8,251,224 B2 * 8/2012 Meger ..... B65D 81/368 206/769
8,544,216 B1 * 10/2013 Hazlett ..... E04H 1/1205 135/143
8,608,529 B2 * 12/2013 Smith ..... A63H 3/52 446/476
D714,879 S * 10/2014 Lebas ..... D21/511
10,155,173 B2 * 12/2018 Simmons ..... G09F 1/06
2001/0034183 A1 * 10/2001 Brownrigg ..... A63H 3/52 446/476
2002/0111106 A1 * 8/2002 Bollman ..... A63H 3/52 446/71
2003/0236052 A1 * 12/2003 Brauer ..... A63H 3/52 446/476
2004/0031211 A1 * 2/2004 Becker ..... B42D 15/042 52/79.5
2004/0166765 A1 * 8/2004 Martin ..... A63H 33/008 446/478
2004/0203317 A1 * 10/2004 Small ..... A63H 33/26 446/476
2005/0230963 A1 * 10/2005 McDowell ..... B42D 1/00 283/81
2006/0009121 A1 * 1/2006 Rotundo ..... A63H 3/52 446/476
2006/0219764 A1 * 10/2006 Copeman ..... A63G 17/00 229/116.1
2007/0173175 A1 * 7/2007 Liss ..... A63H 3/52 446/476
2007/0224912 A1 * 9/2007 Hughes ..... A63H 3/52 446/476
2008/0064291 A1 * 3/2008 Barnes ..... A63H 33/044 446/122
2008/0200095 A1 * 8/2008 Guenette ..... A63H 33/16 446/488
2008/0213735 A1 * 9/2008 Shorr ..... A63H 3/04 434/178
2009/0061729 A1 * 3/2009 Boerman ..... A63H 33/16 446/476
2009/0298385 A1 * 12/2009 Brinckerhoff ..... A63H 33/008 446/487
2010/0023148 A1 * 1/2010 Komorous-Towey .... B32B 3/08 700/97
2012/0321286 A1 * 12/2012 O'Connor ..... A63J 19/00 396/3
2014/0127966 A1 * 5/2014 Williamson ..... A63H 33/008 446/478

* cited by examiner

INVERTIBLE INTERACTIVE TOY HOUSE

FIELD OF THE INVENTION

The field of the invention is toy houses that provide interactivity.

BACKGROUND OF THE INVENTION

Learning disability has been described as a heterogeneous group of disorders manifested by significant difficulties in the acquisition and use of information perceived through the senses with problems recognizing the shape, position, or size of items seen. Some children with a learning disability appear to be unable to process tactile input. Children afflicted with such disabilities or with learning difficulties can benefit from physical interactions, particularly when such interactions are obtained during play with such objects as toy houses when the child has enhanced receptivity to physical contact with familiar objects in the toy house.

There exists a wide variety of toy houses that provide interactivity. An example is U.S. Pat. No. 5,827,103 to Carter, which is a portable dollhouse activity book containing pages depicting rooms of a house with pockets and straps where family dolls may be inserted and a family pet that can be moved from room to mom on a Velcro strap.

Another example is U.S. Pat. No. 5,004,445 to Coleman et al., which is a dollhouse within a dollhouse, containing miniature appliances, furniture and fixtures which contains even smaller displays of furniture and fixtures which can be opened for viewing.

U.S. Pat. No. 6,565,413 to Brownrigg, is for a modular house toy, which is three-dimensional dollhouse with room-simulating modules that can be bought as an entire house or piecemeal, to be collected and added to, and includes furnishing accessories and dolls.

U.S. Pat. No. 7,762,862 to Rotundo et al. is for a house toy and display. It has modifiable modules whose primary purpose is flexibility for display purposes, such that different aspects or features of the house can be displayed at different times.

BRIEF SUMMARY OF THE INVENTION

The above-described products serve essentially as entertainment or amusement devices, whereas, especially for young children, the present invention has a unique design suitable not only for play but for providing tactile experiences with the shape and position of various objects. The invention is the result of extensive testing and modification to maximize its educational purposes, in particular for children with learning difficulties such as disabilities and speech and language deficits/challenges who can benefit from the interactive features. The invention comprises a series of adjacent foldable segments that can be assembled by folding in either of two different directions and joined at its outer edges to form a self-standing toy house. When folded in one direction, the assembled house displays its outside features. When folded in the opposite direction, the assembled house displays inside features.

More specifically, I provide an invertible interactive toy house formed from an elongate structure having a plurality of segments forming the four walls of a house. Adjacent segments are joined together so as to be foldable at the juncture of the segments. Each wall segment is in the shape of a square and topped by a triangular section. The elongate structure can be folded in first direction and joined at the outer edges of the structure to display the square segments as the outside walls of a self-standing toy house and the triangular sections as a hip roof of the house. In this configuration, indicia on the surface of the walls depict features found on the outside of a house, such as doors and windows and shingles on the triangular roof sections.

The elongate structure can be folded in a second direction, opposite the first direction, and joined at the outer edges of the structure to display the four inside walls of a self-standing toy house representing separate rooms of a house, and rooms inside sections of a hip roof. At least the surfaces of the inside walls and the inside of the joined roof sections are formed of a material to which the figures can adhere. Each inner wall has indicia that depict features representing various items found in the rooms of a house. An assortment of figures is provided shaped and designed on a first side with indicia that is associated with the items. The figures are formed of a material that can be removably adhered to the material of the walls or inner surface of the attic of the house formed by the roof. The figures are placed over corresponding representations of the items that the figures represent. Such a material can be felt or other material that provides self-adhesion with felt figures. The figures can be provided as separate items or can provided on one or more sheets of the material to be cut out from the sheets or detachable from the sheets via perforations.

In a particular embodiment, rooms defined by each inside wall and adjacent inside roof section have its own color distinguished from the color of the other room walls and roof sections. Sheets containing depictions of items found in specific rooms can be color coordinated with the room walls and roof sections.

The invention is the result of a series of experiments conducted over several years by the inventor involving children with learning difficulties. These experiments were conducted with a discrete number of such children without third parties present. Different, somewhat crude, toy houses were employed with limited success, until the present invention was reached. It was found through such experimentation that children with learning disabilities playing with the toy house improve various skills, including non-verbal skills of focus and attention; social skills; visual attention and processing skills; and ability to recognize different sizes and shapes, as well as general language skills due to interaction with an instructor as well as the names that apply to various furniture, fixtures, pets, and items, as well as parts of a house. These uses by the inventor were part of developmental testing done solely to determine utility.

BRIEF DESCRIPTION OF THE DRAWINGS

For a more complete understanding of the present invention, reference is now made to the following descriptions taken in conjunction with the accompanying drawings, in which.

DETAILED DESCRIPTION OF THE PREFERRED EMBODIMENT OF THE INVENTION

Assembling the Toy House with the Exterior Walls Showing.

Figure 1:
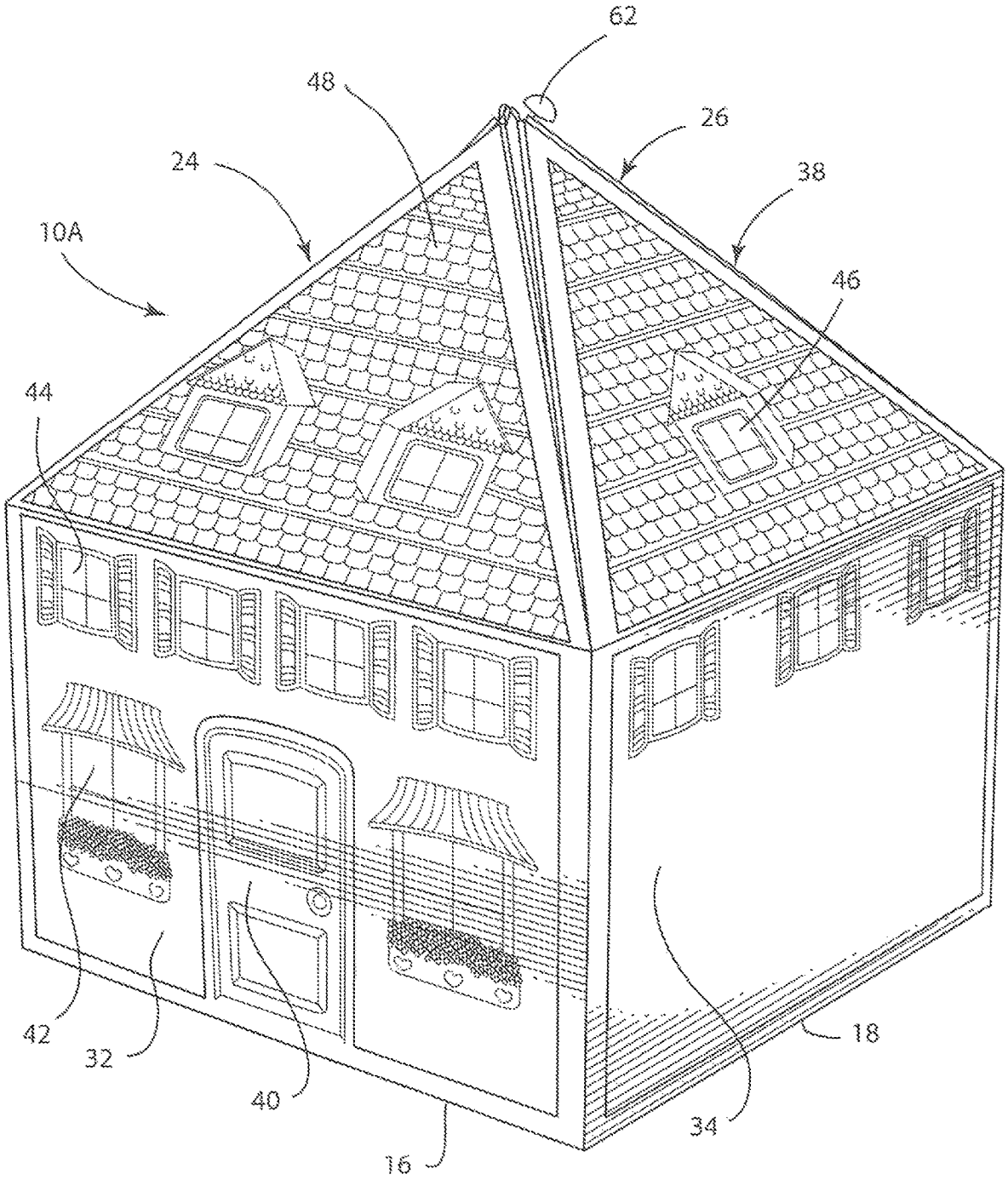
FIG. 1 is a fully assembled toy house formed from four adjacent segments folded and secured in a direction such that outside walls and hip roof of the house are depicted.
Figure 2:
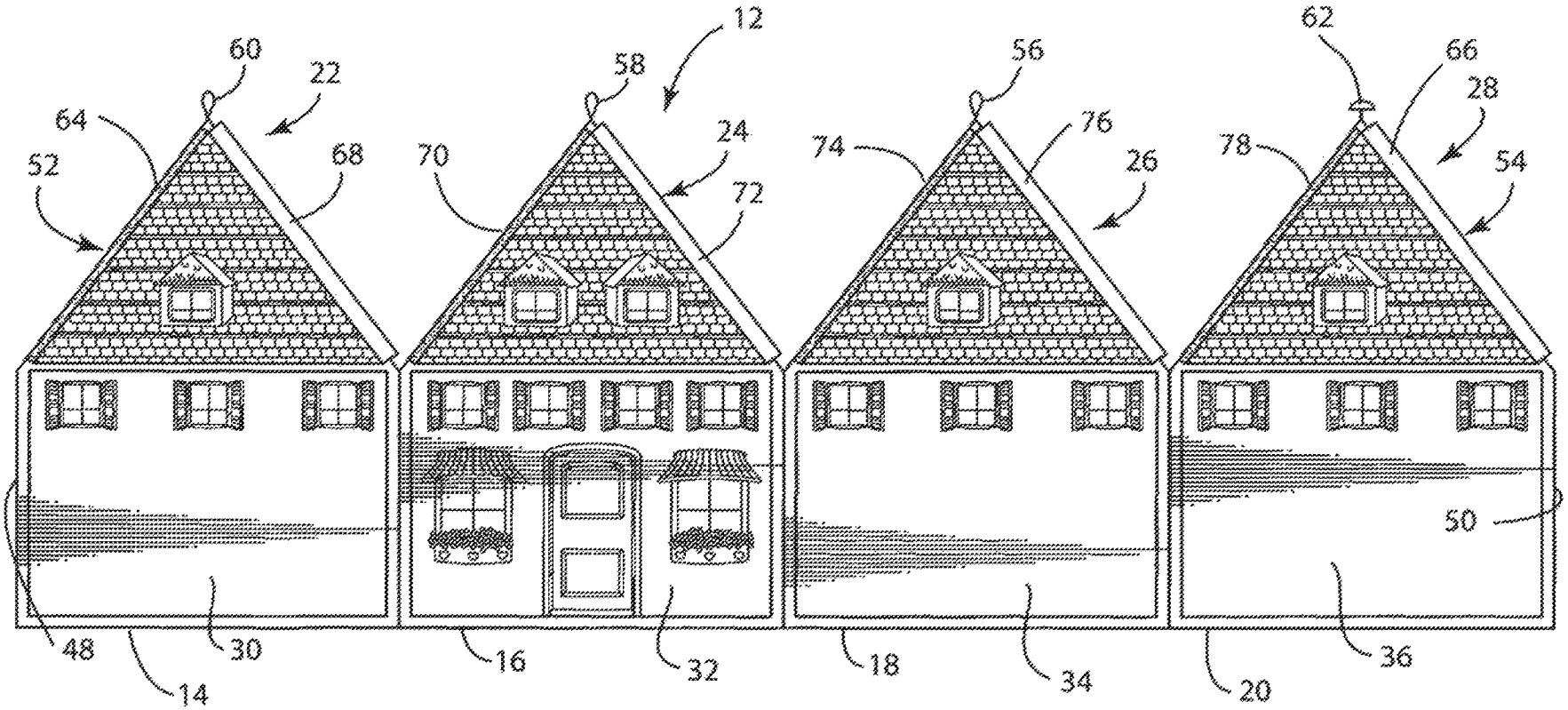
FIG. 2 shows a layout of the house of FIG. 1 unassembled and laid out flat with indicia showing features of the outside of the house.
Figure 4:
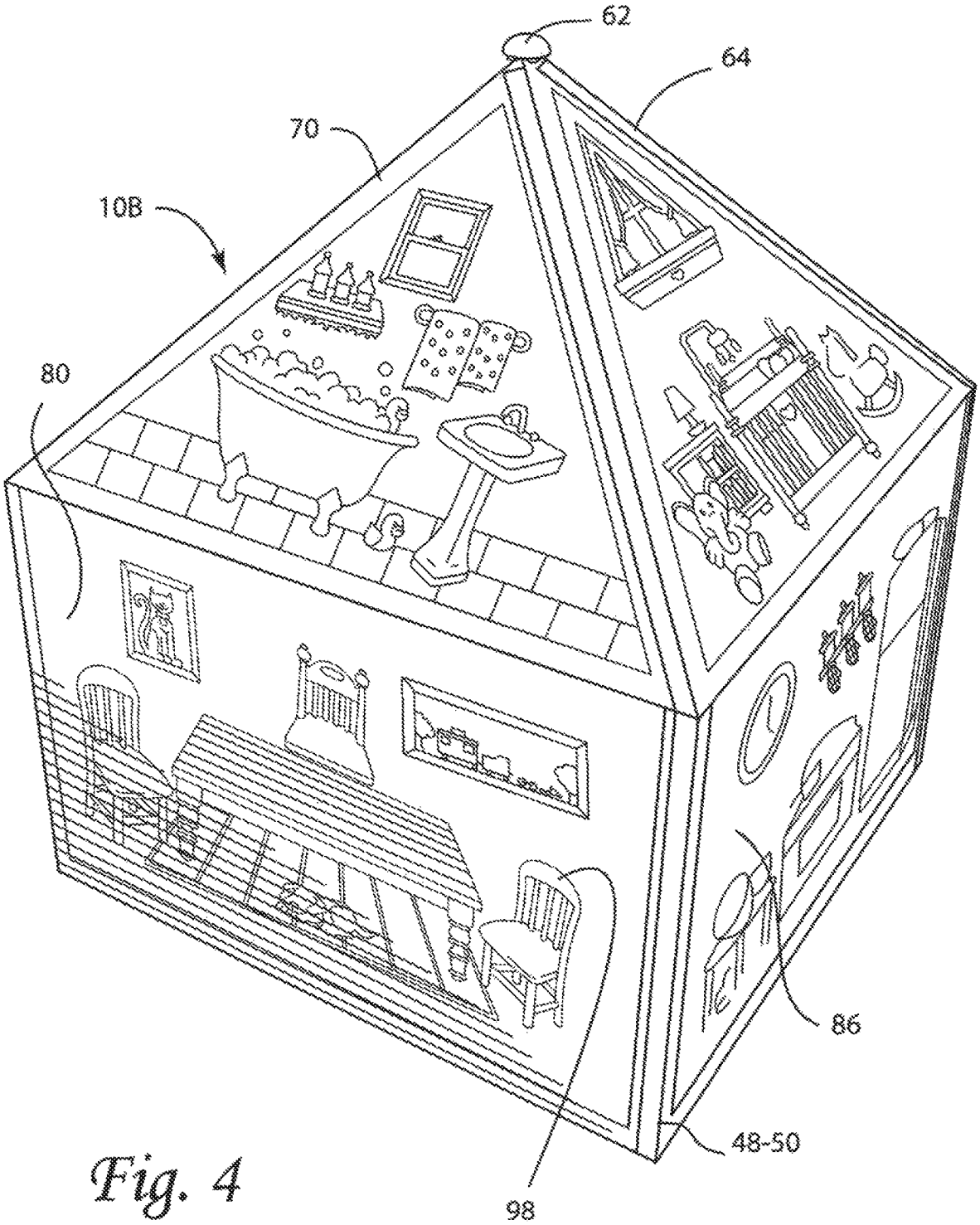
FIG. 4 is a fully assembled toy house formed from the four adjacent segments of FIG. 3 folded and secured in a direction such that inside walls are depicted as well as the inside of rooms in an attic formed by the hip roof.

Referring to FIGS. 1 and 2, this invention is an invertible interactive toy house that can be assembled so as to be self-standing and showing exterior walls (10A) or showing interior walls (FIG. 4, 10B). The house of FIG. 1 is formed from an elongate structure 12 shown in FIG. 2 having, in this exemplary embodiment, four segments, 14, 16, 18, 20, each topped with a triangular section, respectively 22, 24, 26, 28 that fold to form the exterior walls of the house 30, 32, 34, 36 and a hip roof 38. Adjacent segments 14-16, 16-18, and 18-20 are foldable at the junctures of the segments. Each segment 14, 16, 18, 20 is rectangular, square in this embodiment, corresponding to a wall of the house and are formed with respective triangular sections 22, 24, 26, 30 directly above the rectangular sections and which form the hip roof 38. The assembled house of FIG. 1 is decorated with structures typically found on the outside of a house, such as a door 40, front windows such as at 42, other window such as at 44, and attic windows 46 on the roof 38. Shingles 48 are depicted on the hip roof 38.

The toy house 10 as depicted in FIG. 1 is assembled from the elongate structure 12 of FIG. 2 by folding the structure 12 inwardly and joining its outer edges 48 and 50 and the outer edges 52 and 54 of the end triangular sections 22 and 28. Each of the three triangular sections 22, 24, 26 is fitted at its apex with a loop, respectively 56, 58, 60, formed of string and which fits over a button 62 secured to the apex of the outer triangular section 28 to secure the house 10 in its assembled form. FIG. 1 shows the loops just prior to being placed over the button 62. Optionally, strips of pairs of adhering material 64-66, 68-70, 72-74 and 76-78 are fixed to the edges of respective triangular sections 22, 24, 26, 28 to provide additional securement. Such material can be the opposing hooks and loops of Velcro®.

The toy house is illustrated as a residence. Other houses can be represented such as hospitals, schools, farm structures, zoo structures, fire houses, restaurants, and the like.

Assembling the Toy House with the Interior Walls Showing

Figure 3:
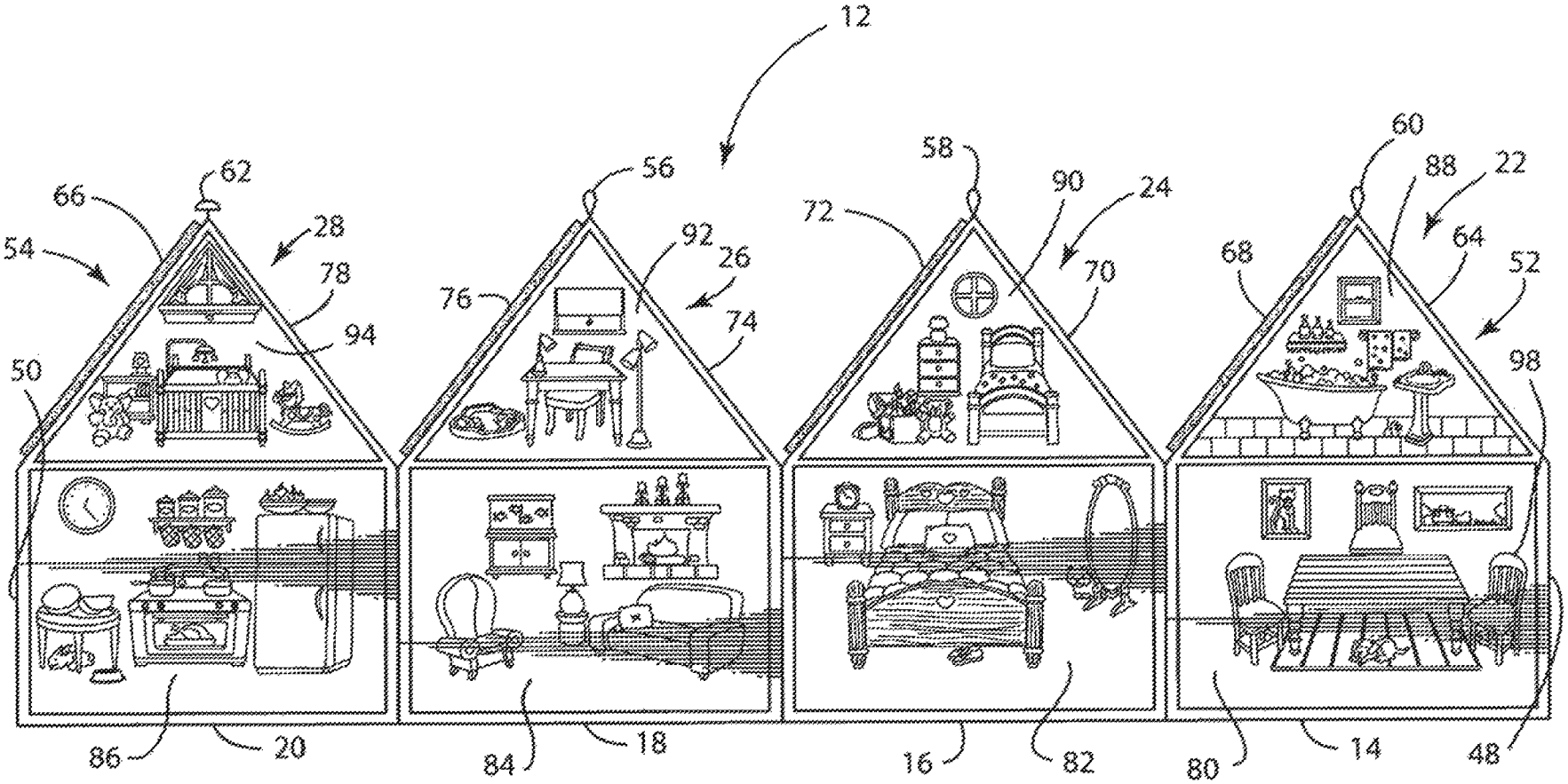
FIG. 3 shows the reverse side of the layout of FIG. 2 with indicia showing features of the interior of the house.

FIG. 3 depicts the opposite side of the elongate structure 12 of FIG. 2. The structure 12 is folded outwardly to assemble the structure 12 as a self-standing house with the interior walls showing. The outer edges 48 and 50 of the structure 12 and the outer edges 52 and 54 of the end triangular sections 22 and 28 are joined. As shown in FIG. 4, after folding, the four segments, 14, 16, 18, 20, and their respective triangular sections 22, 24, 26, 28 form walls with indicia depicting the interior walls of the house 80, 82, 84, 86 and walls with indicia depicting attic or second story rooms 88, 90, 92 94.

Figure 5:
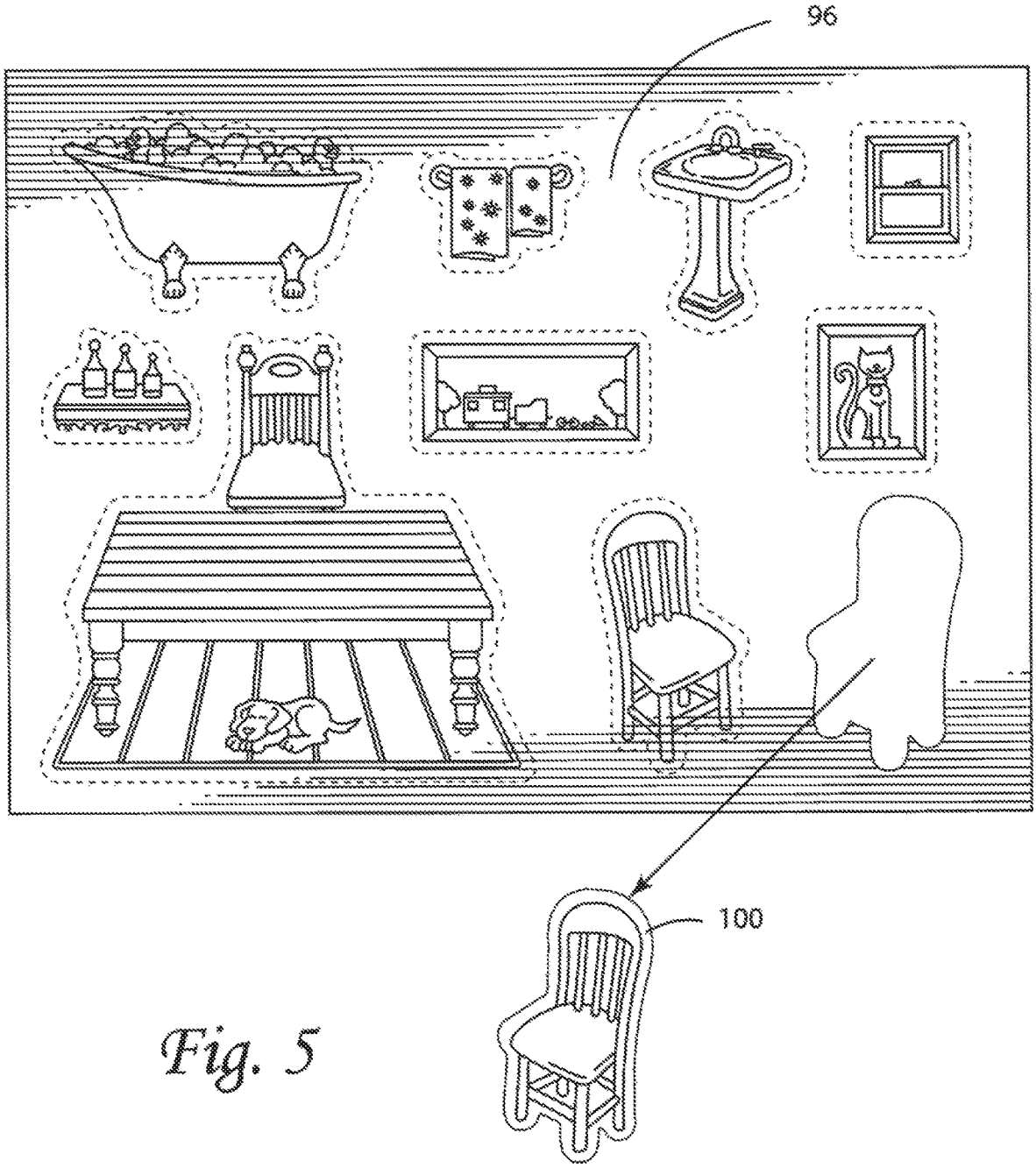
FIG. 5 shows a sheet of flat figures and indicia on one of the inside walls of the house corresponding to the figures, with one of the figures, depicting a chair, removed from the sheet.

The interior walls of the assembled house of FIG. 3 is decorated with indicia depicting items typically found on the inside of a house, such as a chair 98, tables, pictures a bathtub, and other items shown in FIGS. 3 and 4. Referring to FIG. 5, a sheet 96 of flat figures is provided with pictures corresponding to the various indicia on the interior walls 80 and 88 in FIGS. 3 and 4, such as the figure of a chair 100. Other sheets are provided (not shown) that are adorned with items shown on the other walls. In this embodiment, a separate sheet for each interior wall is provided carrying images of items that correspond to the indicia on an associated wall. The images on the sheet 96 are outlined with dashed lines to show where they can be cut out.

The sheets can color coded with the interior wall it corresponds to. For example, sheet 96 and interior walls 80 and 88 can be blue and a sheet corresponding to interior walls 86 and 94 can be green. Other distinguishing colors can be used with other inside walls and sheets.

Figure 6:
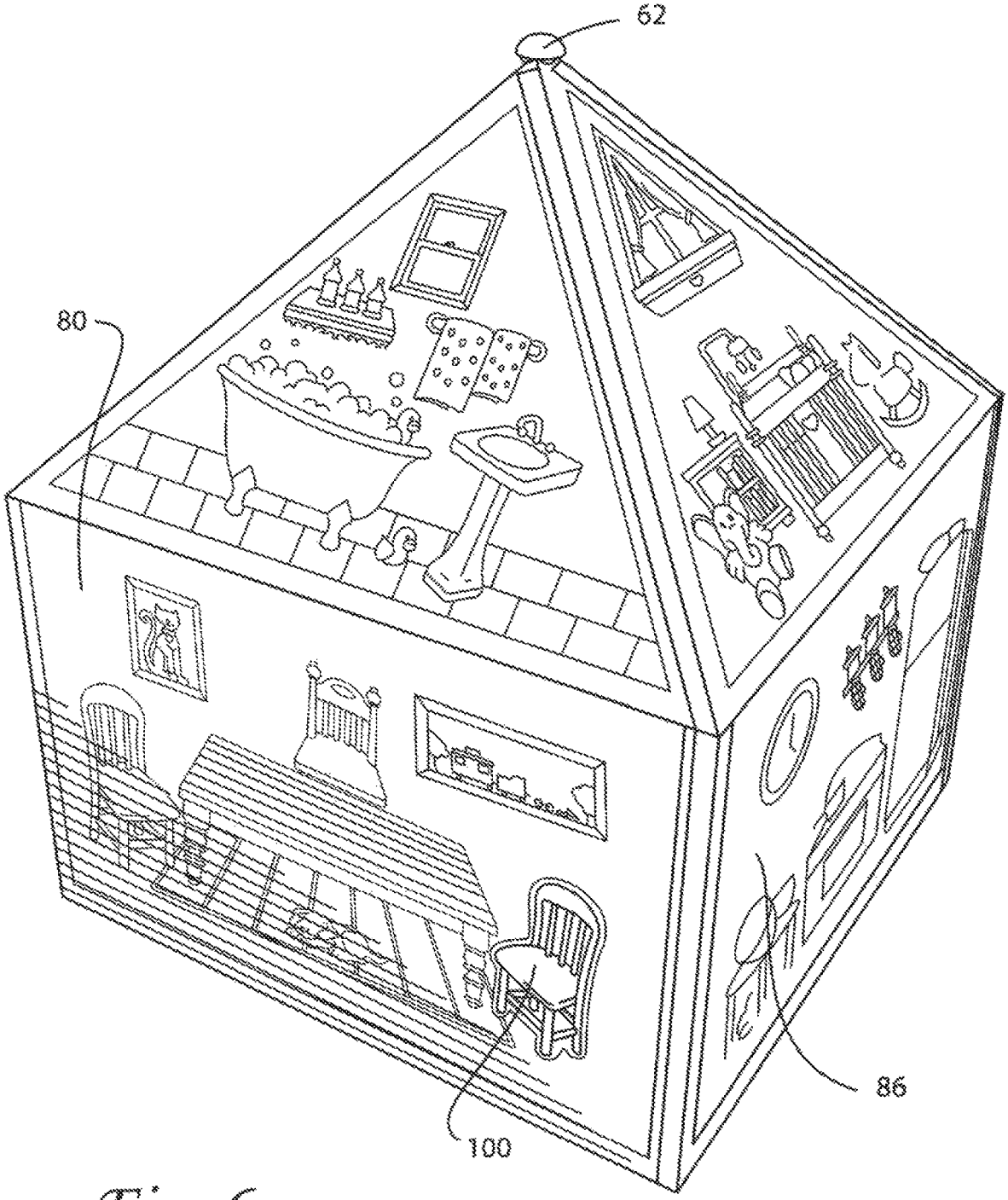
FIG. 6 shows the toy house of FIG. 4 with the chair figure of FIG. 5 adhered to the corresponding chair depicted on one of the interior walls of the house of FIG. 4.

Referring again to FIGS. 4 and 5 and also to FIG. 6, one of the figures, that of a chair 100, is cut out from the sheet 96 and can be placed over the corresponding picture of a chair 98 on one of the interior walls of the assembled house, and adhered to the interior wall as shown in FIG. 6.

Instead of having the figures cut out of a sheet of drawings, the dashed lines in FIG. 5 can be perforations allowing the figures to be punched out of the sheet. An alternative is to have the figures precut with the sheet 96 being a release sheet with the figures being stickers. The stickers could have a slightly adhesive surface and can be put back on the release sheet for use with another child. Another alternative is to provide the figures as totally separate items. In a particular embodiment, the toy house is constructed of felt and the figures are provided as separate items also formed of felt. Felt has the advantageous property of self-sticking, allowing a child to easily apply and remove the figures from the walls. In a preferred embodiment, felt figures are printed on one side with indicia that corresponds to features on the inside walls. Figures can correspond to features on the exterior walls. In other embodiments, in place of felt figures, paper or cardboard figures can be used with light adhesive or with a coating of hooks such as from Velcro®.

The house or inside walls and the figures can be formed of a soft, pliable material, such as felt, which has the advantage of providing a naturally adhesive surface to which the figures can be mildly adhered. Layers of felt can be used, one layer forming the exterior wall, another layer forming the interior walls. Other materials could be used for the house or figures, or for both. The figures can be flat or have a time dimensional extension aspect, the latter providing greater tactile effect.

The toy house can be constructed using a variety of methods to provide rigidity to the walls as desired. For example, plastic or metal wires can be inserted through the seams between the sections. Cardboard, plastic sheeting, or other stiffening material can be inserted between the exterior and interior walls to make the house sturdier.

Manner of Play.

In play with the house, particularly with learning disabled children, the instructor introduces the child to the structure as shown in FIG. 2 and aids the child in assembling the house with outside walls as shown in FIG. 1. The instructor then asks the child if he or she wants to go inside the house. After receiving am affirmative answer, the instructor unfolds the house and helps the child refold it so that the interior walls are exposed as in FIG. 4. In one embodiment the child cuts or punches out removes the figures from the sheet. In other embodiments the child peels of a figure in the form of a sticker from a release sheet, or picks out a figure from a pile of figures. In any event the child hunts for the corresponding item on an inside wall and when finding it places the figure on the wall to cover the item. Alternatively, the child can choose a specific item depicted on an inside wall and then hunt for the figure. This can be repeated until a desired number of figures are adhered to corresponding depictions.

In another method of play, a child can choose to not assemble the house but can use the disassembled elongate structure 12 of FIG. 3 to place figures on the unassembled structure 12.

Although the present invention has been described in connection with the preferred embodiments, it is to be understood that modifications and variations may be utilized without departing from the principles and scope of the invention, as those skilled in the art will readily understand. Accordingly, such modifications may be practiced within the scope of the following claims.

The invention claimed is:

1. An invertible interactive self-standing toy house, consisting of:

an elongate structure consisting of four flat felt segments aligned side-by-side, each segment having a shape whereby to form walls of the house adjacent segments are joined together so as to be foldable at the juncture of the segments, all of the wall segments having the same shape, each wall segment being in the shape of a square and topped by a triangular segment, the triangular segments being displayed as a hip roof of the house;

the elongate structure in one arrangement being folded in a first direction and joined at the outer edges of the structure forms a completely closed first configuration that shows exposed exterior walls of the self-standing toy house when the structure is closed;

the elongate structure in another arrangement being folded in a second direction opposite the first direction and joined at the outer edges of the structure forms a completely closed second configuration that shows exposed interior walls of the self-standing toy house when the structure is closed;

both sides of each wall bearing graphics, the graphics of the exposed walls of the first configuration defining the first configuration walls as exterior walls different from the graphics of the exposed interior walls of the second configuration, the graphics on the exposed exterior walls of the first configuration depicting a plurality of features on the outside walls of a house, the graphics on the exposed interior walls of the second configuration defining the second configuration walls as interior walls depicting a plurality of features representing various items found in rooms in the interior of a house, each of a plurality of interior walls bearing a plurality of said features, the features depicted on the exposed interior walls include features that are different from the features depicted on the exposed exterior walls; and a plurality of flat felt figures shaped and designed with indicia that depict said various items that are also depicted on the exposed interior walls and having both indicia and shapes that correspond to and have the same indicia and shapes of the items depicted on the exposed interior walls, the surface of the exposed interior walls and a surface of each of the figures being such that the figures can adhere to indicia that correspond to the figures on the exposed interior walls to cover the corresponding indicia, the indicia on the exposed interior walls thereby having the function of indicating where the figures should be placed to help a child cover a corresponding figure on the exposed interior wall.

2. The invertible interactive toy house of claim 1 in which the house is a residence.

3. The invertible interactive toy house of claim 1 in which the outer sections of the hip roof have indicia depicting shingles.

4. The invertible interactive toy house of claim 1 wherein the figures are printed on at least one sheet of material and are obtained by removing the figures out of the sheet.

5. The invertible interactive toy house of claim 1 wherein the figures are provided preformed as separate items.

6. The invertible interactive toy house of claim 1 wherein the figures are printed on a plurality of sheets of material and are color coordinated with the surfaces of the inner walls of the toy house, the sheets depicting indicia on surfaces of the inner walls.

7. The invertible interactive toy house of claim 1 wherein the indicia on the surface of different exposed interior walls depict items found in different rooms of a house.

8. The invertible interactive toy house of claim 1 wherein the surfaces of inside sections of the hip roof has indicia depicting different rooms of a house and features representing various items found in the rooms.

* * * * *